US011118406B2

(12) United States Patent
Caresta et al.

(10) Patent No.: US 11,118,406 B2
(45) Date of Patent: Sep. 14, 2021

(54) DRILLING SYSTEMS AND METHODS

(71) Applicant: Schlumberger Technology Corporation, Sugar Land, TX (US)

(72) Inventors: Mauro Caresta, Cambridge (GB); Fabio Cappi, Trondheim (NO); Hans Seehuus, Trondheim (NO); Kjell Haugvaldstad, Trondheim (NO); Riadh Boualleg, Stonehouse (GB); Joachim Sihler, Cambridge (GB); Ashley Bernard Johnson, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 151 days.

(21) Appl. No.: 16/025,441

(22) Filed: Jul. 2, 2018

(65) Prior Publication Data

US 2020/0003009 A1 Jan. 2, 2020

(51) Int. Cl.

| | |
|---|---|
| ***E21B 7/04*** | (2006.01) |
| ***E21B 7/06*** | (2006.01) |
| ***E21B 10/42*** | (2006.01) |

(52) U.S. Cl.

CPC ..... *E21B 7/062* (2013.01); *E21B 7/04* (2013.01); *E21B 7/064* (2013.01); *E21B 10/42* (2013.01)

(58) Field of Classification Search

CPC ... E21B 7/04; E21B 7/06; E21B 7/062; E21B 7/064

See application file for complete search history.

(56) References Cited

U.S. PATENT DOCUMENTS

| | | | | |
|---|---|---|---|---|
| 1,635,593 | A * | 7/1927 | Wadsworth | E21B 10/246 175/57 |
| 2,142,859 | A | 1/1939 | McMahan | |
| 2,179,567 | A | 11/1939 | Strength | |
| 2,197,227 | A | 4/1940 | Strength | |
| 2,212,594 | A | 8/1940 | Evans | |
| 3,297,100 | A * | 1/1967 | Crews | E21B 17/18 175/195 |
| 4,083,415 | A * | 4/1978 | Kita | E21B 10/38 173/132 |
| 4,106,823 | A * | 8/1978 | Bassinger | E21B 17/1078 175/325.4 |
| 4,947,944 | A | 8/1990 | Coltman et al. | |
| 4,948,925 | A | 8/1990 | Winters et al. | |
| 5,601,151 | A | 2/1997 | Warren | |
| 5,931,239 | A | 8/1999 | Schuh | |
| 5,941,323 | A | 8/1999 | Warren | |

(Continued)

FOREIGN PATENT DOCUMENTS

| | | |
|---|---|---|
| WO | 2015127345 A2 | 8/2015 |
| WO | 2016187373 A1 | 11/2016 |

OTHER PUBLICATIONS

Combined Search and Exam Report under Sections 17 and 18(3) United Kingdom Patent Application No. 1705424.8 dated Jul. 27, 2017, 5 pages.

(Continued)

*Primary Examiner* — Cathleen R Hutchins

(57) ABSTRACT

A directional drilling system that includes a drill bit that drills a bore through rock. The drill bit includes an outer portion of a first material and an inner portion coupled to the outer portion. The inner portion includes a second material.

18 Claims, 13 Drawing Sheets

(56) References Cited

U.S. PATENT DOCUMENTS

| | | | | |
|---|---|---|---|---|
| 8,534,380 | B2 | 9/2013 | Sheppard et al. | |
| 8,727,036 | B2 | 5/2014 | Johnson et al. | |
| 8,899,352 | B2 | 12/2014 | Johnson et al. | |
| 9,109,402 | B1 * | 8/2015 | Lasater | E21B 7/062 |
| 9,714,543 | B2 | 7/2017 | Downie et al. | |
| 2002/0179336 | A1 | 12/2002 | Schaaf et al. | |
| 2006/0144623 | A1 | 7/2006 | Ollerensaw et al. | |
| 2008/0115974 | A1 | 5/2008 | Johnson et al. | |
| 2009/0044980 | A1 | 2/2009 | Sheppard et al. | |
| 2010/0116551 | A1 | 5/2010 | Southard | |
| 2010/0139983 | A1 | 6/2010 | Hallworth et al. | |
| 2011/0139513 | A1 | 6/2011 | Downton | |
| 2012/0080235 | A1 | 4/2012 | Sheppard et al. | |
| 2013/0213713 | A1 | 8/2013 | Smith et al. | |
| 2014/0262507 | A1 | 9/2014 | Marson et al. | |
| 2016/0060959 | A1 | 3/2016 | Lehr et al. | |
| 2016/0060960 | A1 * | 3/2016 | Parkin | E21B 17/10 175/24 |
| 2017/0002608 | A1 * | 1/2017 | Davis | E21B 7/067 |
| 2017/0058617 | A1 | 3/2017 | Bartel | |
| 2018/0283103 | A1 | 10/2018 | Caresta | |
| 2020/0003010 | A1 | 1/2020 | Bittleston et al. | |
| 2020/0003011 | A1 | 1/2020 | Sihler et al. | |

OTHER PUBLICATIONS

International Search Report and Written Opinion issued in International Patent Application No. PCT/US2018/025986 dated Jul. 27, 2018, 16 pages.

Office Action issued in U.S. Appl. No. 15/945,158 dated Jan. 18, 2019, 8 pages.

Office Action issued in U.S. Appl. No. 16/025,523 dated Mar. 10, 2020, 11 pages.

International Preliminary Report on Patentability issued in International Patent Application No. PCT/US2018/025986 dated Oct. 17, 2019, 14 pages.

Office Action issued in U.S. Appl. No. 16/025,480 dated Jan. 14, 2020, 8 pages.

Office Action issued in U.S. Appl. No. 16/025,523 dated Aug. 10, 2020, 12 pages.

Office Action issued in U.S. Appl. No. 16/025,523 dated Dec. 28, 2020, 12 pages.

First Office Action issued in Chinese Patent Application 201880042655.1 dated Oct. 28, 2020, 11 pages with partial English translation.

Office Action issued in U.S. Appl. No. 16/826,976 dated Mar. 3, 2021.

* cited by examiner

DRILLING SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure generally relates to a steering assembly for directionally drilling a borehole in an earth formation. Directional drilling is the intentional deviation of a borehole from the path it would naturally take, which may include the steering of a drill bit so that it travels in a predetermined direction. In many industries, it may be desirable to directionally drill a borehole through an earth formation in order to, for example, circumvent an obstacle and/or to reach a predetermined location in a rock formation.

In the oil and gas industry, boreholes are drilled into the earth to access natural resources (e.g., oil, natural gas, water) below the earth's surface. These boreholes may be drilled on dry land or in a subsea environment. In order to drill a borehole for a well, a rig is positioned proximate the natural resource. The rig suspends and powers a drill bit coupled to a drill string that drills a bore through one or more layers of sediment and/or rock. After accessing the resource, the drill string and drill bit are withdrawn from the well and production equipment is installed. The natural resource(s) may then flow to the surface and/or be pumped to the surface for shipment and further processing.

Directional drilling techniques have been developed to enable drilling of multiple wells from the same surface location with a single rig, and/or to extend wellbores laterally through their desired target formation(s) for improved resource recovery. Each borehole may change direction multiple times at different depths between the surface and the target reservoir by changing the drilling direction. The wells may access the same underground reservoir at different locations and/or different hydrocarbon reservoirs. For example, it may not be economical to access multiple small reservoirs with conventional drilling techniques because setting up and taking down a rig(s) can be time consuming and expensive. However, the ability to drill multiple wells from a single location and/or to drill wells with lateral sections within their target reservoir(s) may reduce cost and environmental impact.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates generally to systems and methods for directionally drilling a borehole, including without limitation those of U.S. patent application Ser. No. 15/945,158, which is hereby incorporated by reference in entirety and for all purposes.

In embodiments, a directional drilling system includes a drill bit that drills a bore through rock. The drill bit includes an outer portion of a first material and an inner portion, coupled to the outer portion, that includes a second material.

In embodiments, a directional drilling system includes a drill bit, a drive shaft coupled to the drill bit and configured to transfer rotational power from a motor to the drill bit, and a bearing system coupled to the drive shaft, where the bearing system includes an inner bearing that surrounds and axially couples to the drive shaft and an outer bearing that surrounds the inner bearing.

In embodiments, a directional drilling system includes a steering system that controls a drilling direction of a drill bit. The steering system includes a sleeve with a channel. A steering pad couples to the sleeve, and axial movement of the steering pad with respect to the drill bit changes the drilling direction by changing a steering angle. The steering pad couples to the sleeve with a coupling feature that enables the steering pad to move axially within the channel.

Additional details regarding operations of the drilling systems and methods of the present disclosure are provided below with reference to FIGS. 1-17.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
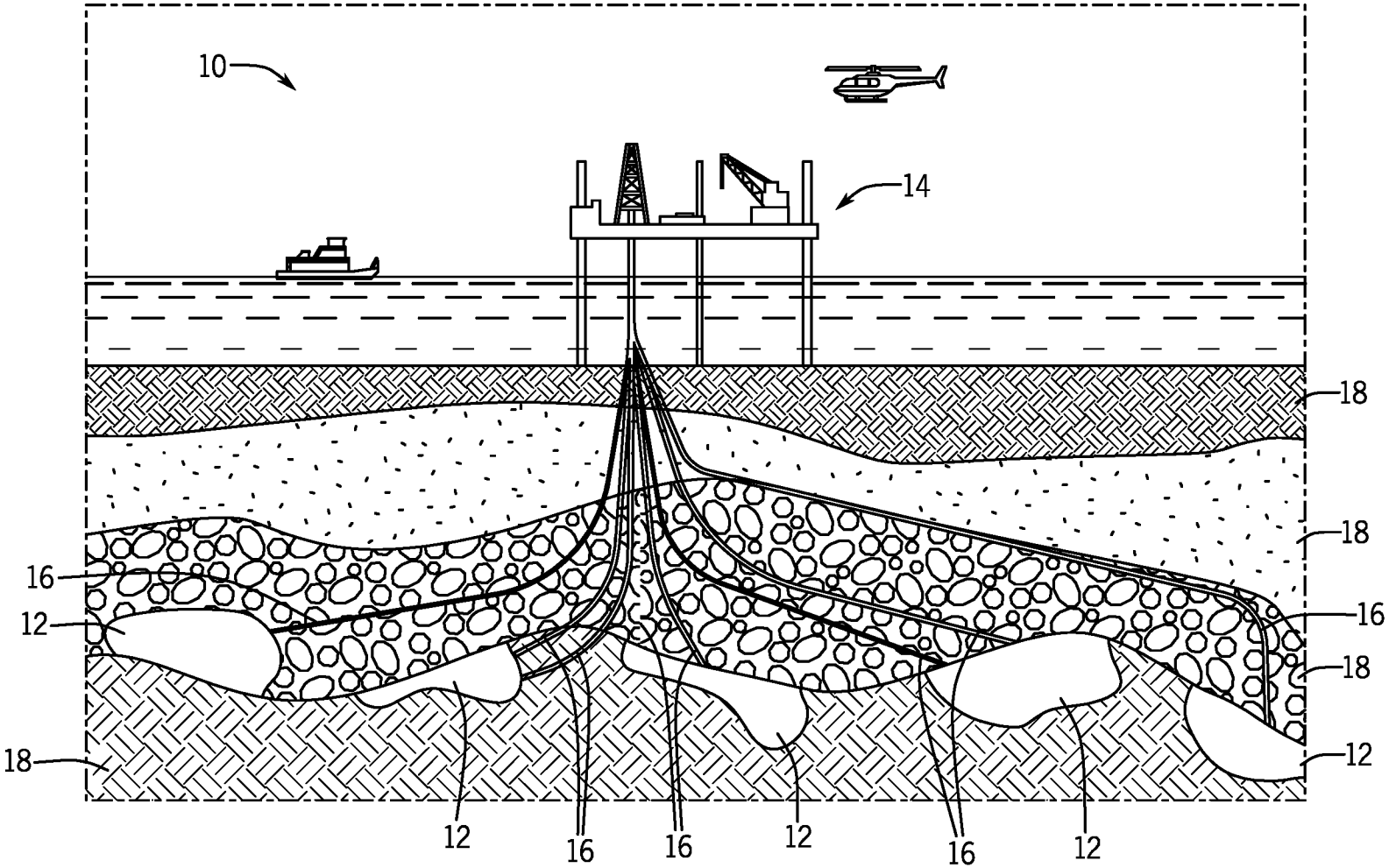
FIG. 1 schematically illustrates a rig coupled to a plurality of wells for which the drilling systems and methods of the present disclosure can be employed to directionally drill the boreholes.

One or more specific embodiments of the present disclosure will be described below. These described embodiments are only exemplary of the present disclosure. Additionally, in an effort to provide a concise description of these exemplary embodiments, all features of an actual implementation may not be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "including" and "having" are used in an open-ended fashion, and thus should be interpreted to mean "including, but not limited to." Any use of any form of the terms "couple," "connect," "attach," "mount," or any other term describing an interaction between elements is intended to mean either a direct or an indirect interaction between the elements described. Moreover, any use of "top," "bottom," "above," "below," "upper," "lower," "up," "down," "vertical," "horizontal," "left," "right," and variations of these terms is made for convenience but does not require any particular orientation of components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

The discussion below describes drilling systems and methods for controlling the orientation of a drill bit while drilling a borehole. The assemblies of the present disclosure are disposed above the drill bit and may include one or more over-gauge pads, where "over-gauge" refers to the pad having one or more points of extension greater than a nominal full-gauge or "gauge" as defined by a maximum drill bit cutter tip extension in a radial direction. Thus, for example, the radius of an over-gauge pad at a particular point is greater than the full-gauge radius of the drill bit in that radial direction. In embodiments, an over-gauge pad may include full-gauge and/or under-gauge area(s), where under-gauge refers to having one or more points of extension less than gauge as defined by a maximum drill bit cutter tip extension in that radial direction. Over-gauge pads will be referred to as "steering pads" below.

FIG. 1 schematically illustrates an exemplary drill site 10 in which the systems and methods of the present disclosure can be employed. The drill site 10 may be located either offshore (as shown) or onshore, near one or multiple hydrocarbon-bearing rock formations or reservoirs 12 (e.g., for the production of oil and/or gas), or near one or more other subsurface earth zone(s) of interest. Using directional drilling and the systems and methods presently described, a drilling rig 14 with its related equipment can drill multiple subsurface boreholes for wells 16 beginning from a single surface location for a vertical bore. Once completed, these wells 16 may fluidly connect to the same hydrocarbon reservoir 12 at different locations and/or to different reservoirs 12 in order to extract oil and/or natural gas.

As illustrated, each well 16 may define a different trajectory, including for example different degrees and/or lengths of curvature, in order to access and/or maximize surface area for production within the hydrocarbon reservoir(s) 12. The trajectory of a well 16 may depend on a variety of factors, including for example the distance between target reservoir (s) 12 and the rig 14, horizontal extension of a reservoir for hydrocarbon capture, as well as predicted and/or encountered rock stratigraphy, drilling obstacles, etc. between the surface and the subsurface drilling target(s). There may varying rock formation layers 18 between the rig 14 and a hydrocarbon reservoir 12, with some of layers 18 easily and relatively quickly drilled through, and other layers 18 time consuming and subject to increased wear on drilling components. The optimal trajectory to access a hydrocarbon reservoir 12 therefore may not be the shortest distance between the rig 14 and the hydrocarbon reservoir 12.

A drilling plan may be developed to include a trajectory for each proposed well 16 that takes into account properties (e.g., thicknesses, composition) of the layers 18. Following the drilling plan, borehole(s) for the well(s) 16 may be drilled to avoid certain layers 18 and/or drill through thinner portions of difficult layers 18 using directional drilling and/or to extend a substantially horizontal section through a reservoir 12. Directional drilling may therefore reduce drill time, reduce wear on drilling components, and fluidly connect the well 16 at or along a desired location in the reservoir 12, among other factors.

In FIG. 1, the rig 14 is an offshore drilling rig using directional drilling to drill the wells 16 below a body of water. It should be understood that directional drilling may be done with onshore rigs as well. Moreover, while the wells 16 may be wells for oil and gas production from hydrocarbon-bearing reservoirs, directional drilling is and can be performed for a variety of purposes and with a variety of targets within and outside of the oil and gas industry, including without limitation in water, geothermal, mineral, and exploratory applications. Additionally, while FIG. 1 illustrates multiple well 16 trajectories extending from one rig 14 surface location, the number of wells extending from the same or similar surface location may be one or otherwise may be more or less than shown.

Figure 2:
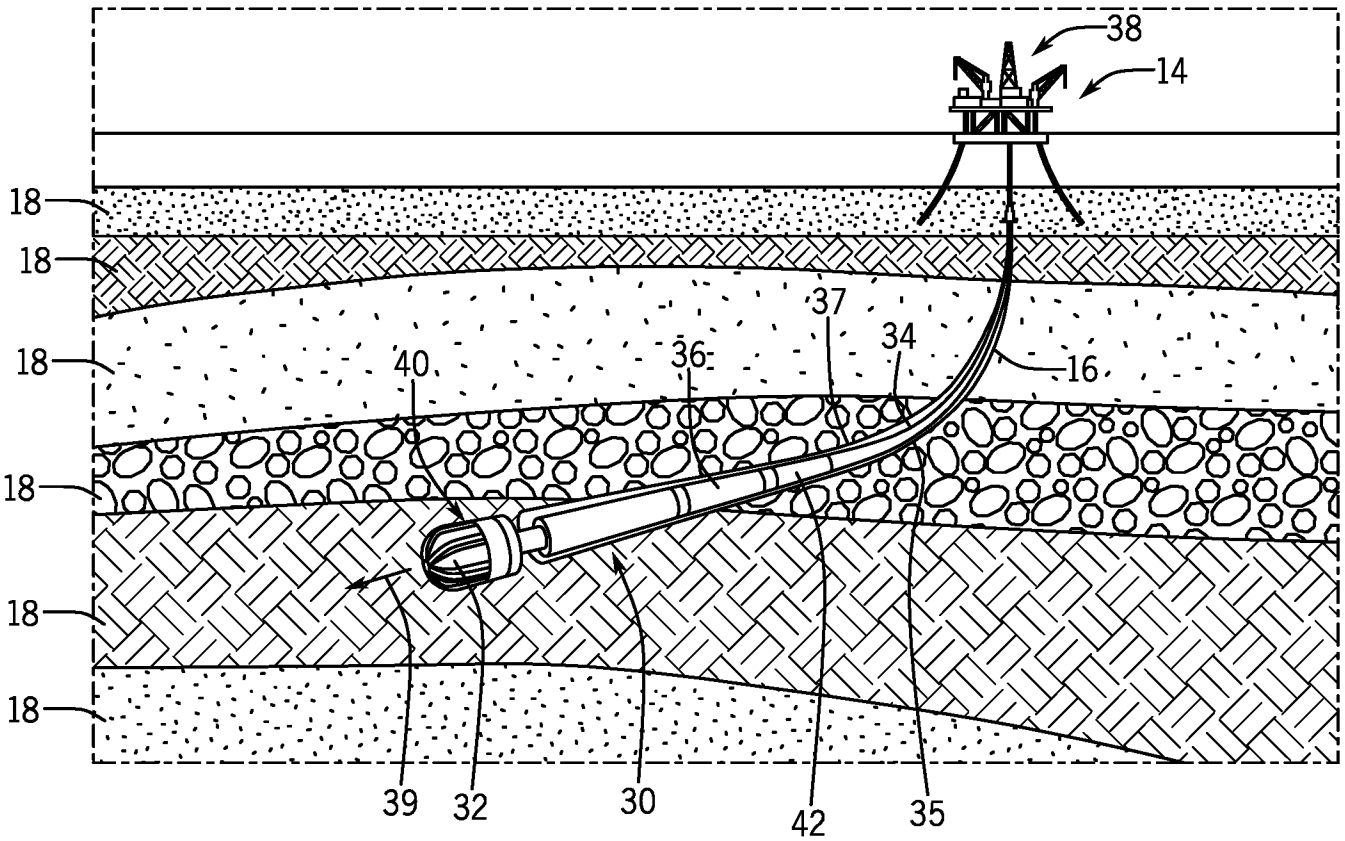
FIG. 2 schematically illustrates an exemplary directional drilling system coupled to a rig according to an embodiment of the present disclosure.

FIG. 2 schematically illustrates an exemplary directional drilling system 30 coupled to a rig 14. The directional drilling system 30 includes at bottom a drill bit 32 designed to break up rock and sediments into cuttings. The drill bit 32 couples to the rig 14 using a drill string 34. The drill string 34 is formed with a series of conduits, pipes or tubes that couple together between the rig 14 and the drill bit 32. In order to carry the cuttings away from the drill bit 32 during a drilling operation, drilling fluid, also referred to as drilling mud or mud, is pumped from surface through the drill string 34 and exits the drill bit 32. The drilling mud then carries the cuttings away from the drill bit 32 and toward the surface through an annulus 35 between an inner wall of the borehole 37 formed by the drill bit 32 and an outer wall of the drill string 34. By removing the cuttings from the borehole 37 for a well 16, the drill bit 32 is able to progressively drill further into the earth.

In addition to carrying away the cuttings, the drilling mud may also power a hydraulic motor 36 also referred to as a mud motor. Drilling mud is pumped into the borehole 37 at high pressures in order to carry the cuttings away from the drill bit 32, which may be at a significant lateral distance and/or vertical depth from the rig 14. As the mud flows through the drill string 34, it enters a hydraulic motor 36. The flow of mud through the hydraulic motor 36 drives rotation of the hydraulic motor 36, which in turn rotates a shaft coupled to the drill bit 32. As the shaft rotates, the drill bit 32 rotates, enabling the drill bit 32 to cut through rock and sediment. In some embodiments, the hydraulic motor 36 may be replaced with an electric motor that provides power to rotate the drill bit 32. In still other embodiments, the directional drilling system 30 may not include a hydraulic motor or electric motor on the drill string 34. Instead, the drill bit 32 may rotate in response to rotation of the drill string 34 from at or near the rig 14, for example by a top drive 38 on the rig 14, or a kelly drive and rotary table, or by any other device or method that provides torque to and rotates the drill string 34.

In order to control a drilling direction 39 of the drill bit 32, the directional drilling system 30 may include a steering system 40 of the present disclosure. As will be discussed in detail below, the steering system 40 includes a steering sleeve with one or more steering pads that can change and control the drilling direction 39 of the drill bit 32. The steering system 40 may be controlled by an operator and/or autonomously using feedback from a measurement-while-drilling system 42. The measurement-while-drilling system 42 uses one or more sensors to determine the well path or borehole drilling trajectory in three-dimensional space. The sensors in the measurement-while-drilling system 42 may provide measurements in real-time and/or may include accelerometers, gyroscopes, magnetometers, position sensors, flow rate sensors, temperature sensors, pressure sensors, vibration sensors, torque sensors, and/or the like, or any combination of them.

Figure 3:
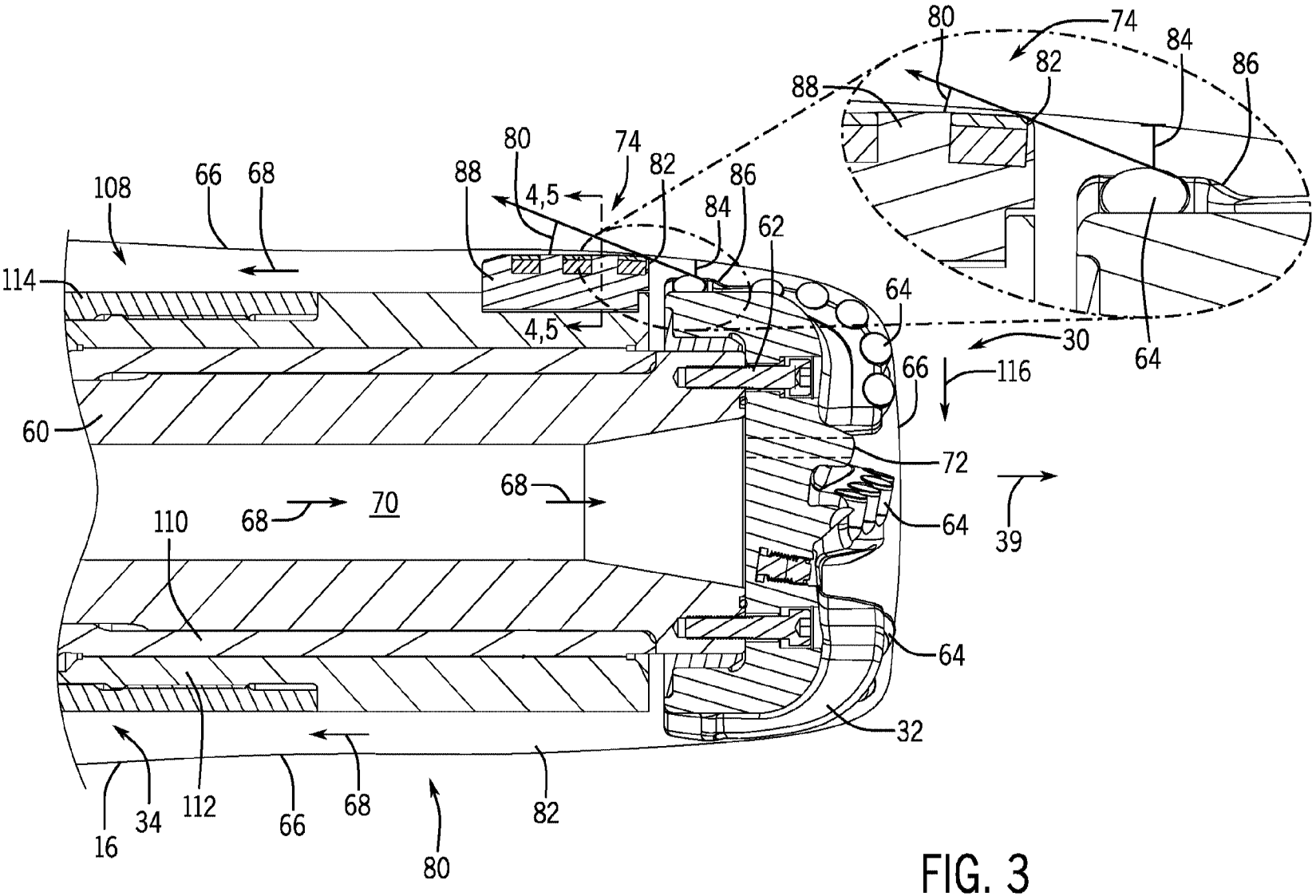
FIG. 3 is a cross-sectional view of a directional drilling system with a steering system according to an embodiment of the present disclosure.

FIG. 3 is a cross-sectional view of an embodiment of a directional drilling system 30 with a steering system 40 of the present disclosure. As explained above with reference to FIG. 2, the directional drilling system 30 includes at bottom a drill bit 32 capable of cutting through rock and/or sediment to drill a borehole for a well 16. The drill bit 32 may be powered by a motor (e.g., hydraulic or mud motor, electric motor) that in operation transfers torque to the drill bit 32 through a drive shaft 60. The drill bit 32 may couple to the drive shaft 60 with one or more bolts 62 enabling power transfer from the motor. As the drive shaft 60 rotates, torque drives rotation of the drill bit 32, enabling cutters or teeth 64 (e.g., polycrystalline diamond teeth) to grind into the rock face 66. As the teeth 64 grind against the rock face 66, the rock face 66 breaks into pieces called cuttings. The cuttings are then carried away from the rock face 66 with drilling mud 68. The drilling mud 68 flows through a conduit or passageway 70 in the drive shaft 60 and through openings, nozzles or apertures 72 in the drill bit 32, carrying cuttings around the drill bit 32 and back through the recently drilled bore.

In order to steer the directional drilling system 30 and more specifically control the orientation of the drill bit 32, the directional drilling system 30 of the present disclosure includes the steering system 40. The steering system 40 in FIG. 3 includes one or more steering pads 74 (e.g., one, two, three, four, five, six or more steering pads). The steering pad 74 forms a steering angle 80 between the drill bit 32 (e.g., outermost surface of a cutter 64 of the drill bit 32) and an edge 82 of the steering pad 74. For example, the angle 80 may be formed between the outermost cutters 64 and the edge 82 of the steering pad 74.

As illustrated, the steering pad 74 extends a radial distance 84 beyond the outermost radial surface as defined by the outermost cutter extension in the radial direction of the drill bit 32, which places the steering pad(s) 74 into contact with the rock face 66 surrounding the bore. In other words, the steering pad 74 is over-gauge, and the radial distance 84 is an over-gauge radial distance. For example, the over-gauge radial distance 84 may be in a range between about 0.1 to 20 mm, 0.1 to 10 mm, and/or 0.1 to 5 mm. In embodiments, the steering sleeve also may include an under-gauge section opposite the over-gauge section, as described in U.S. patent application Ser. No. 15/945,158, incorporated by reference herein in entirety for all purposes.

As illustrated, the steering pad(s) 74 may couple to a bearing system 108 that enables the drive shaft 60 to rotate while blocking rotation of the steering pads 74. The bearing system 108 includes an inner bearing 110 and an outer bearing 112 (e.g., a sleeve). The inner bearing 110 couples to and rotates with the drive shaft 60, while the outer bearing 112 couples to a housing 114 (e.g., a mud motor housing or motor collar) and also to the steering pad(s) 74.

In the circumferential position shown in FIG. 3, the steering pad 74 drives the drilling direction of the drill bit 32 from an axial direction 39 toward a lateral direction 116. However, after drilling to a particular depth, and/or according to a drill plan or encountered obstacle or the like, it may be desirable to adjust the drilling direction of the drill bit 32 to a different direction, e.g. from the lateral direction 116 toward the axial direction 39. In order to adjust the drilling direction from 116 to 39 (e.g. axial direction relative to the drive shaft 60 from a substantially lateral direction), the steering pad(s) 74 are rotated about the drive shaft 60 from the first circumferential position to a second circumferential position. As the outer bearing 112 is coupled to both the motor housing 114 and the steering pad 74, the motor housing 114 may be rotated in order to rotate the outer bearing 112 and thus the steering pad 74. The motor housing 114 may be rotated through rotation of the drill string 34 using a top drive 38 on the rig 14 (as schematically shown in FIG. 2), by kelly and rotary table, or by any other device or method that provides torque to and rotates the drill string 34. Once the steering pad 74 is repositioned to the second circumferential position, the steering pad 74 drives the drill bit 32 to the adjusted drilling direction 39.

Figure 4:
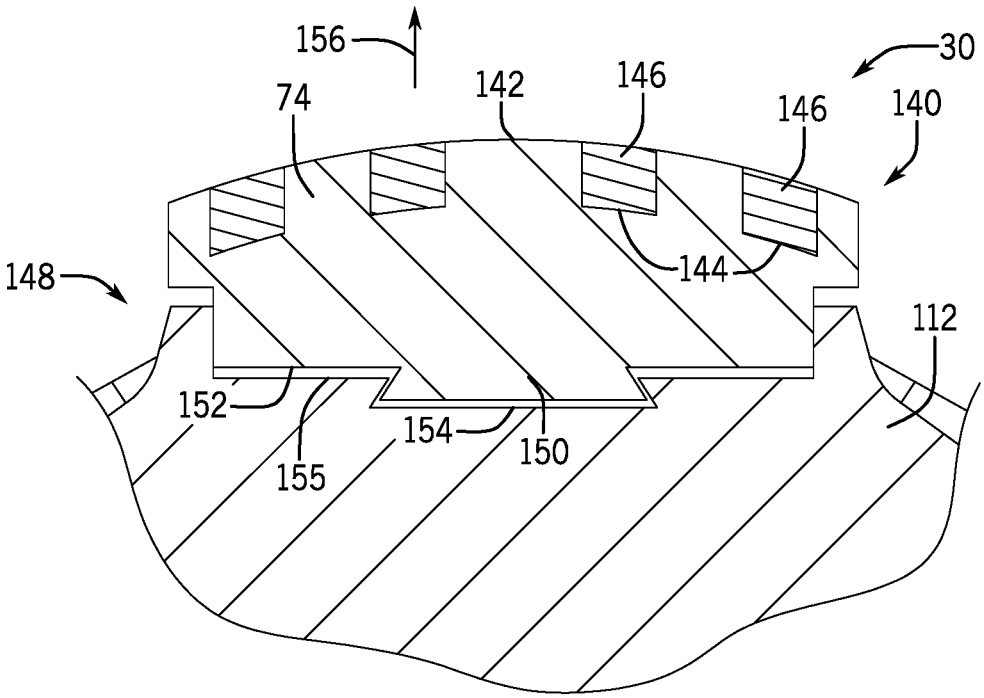
FIG. 4 is a cross-sectional view of a steering pad coupled to a directional drilling system within line 4-4 of FIG. 3 according to an embodiment of the present disclosure.

FIG. 4 is a cross-sectional view of an embodiment of a steering pad 74 coupled to an outer bearing 112 or sleeve of a directional drilling system 30, within line 4-4' of FIG. 3. The steering pad 74 includes a body 140 made out of a first material (e.g., carbides, including without limitation tungsten or other transition metal carbides). The body 140 defines a curvilinear surface 142 configured to engage the rock face 66 described above. The body 140 may also include a plurality of counterbores 144 in the curvilinear surface 142. Although they are shown to be parallel, the counterbores 144 may be in other orientations, including without limitation perpendicular to the surface steering pad 74, aligned radially from the center of the tool, and/or spaced evenly or unevenly in either or both of the radial and axial directions relative to the drive shaft 60.

The counterbores 144 enable the steering pad 74 to receive a plurality of inserts 146. The inserts 146 may include diamond inserts, boron nitride inserts, carbide inserts (e.g., tungsten or other transition metal carbide inserts), or a combination thereof. The inserts could be conventional polycrystalline diamond cutters (PDC or PCD cutters). These inserts 146 provide abrasion resistance as the steering pad 74 engages the rock face 66.

A coupling feature 148 enables the steering pad 74 to couple to the outer bearing 112 or sleeve surrounding the drive shaft 60 (described above). In some embodiments, the coupling feature 148 may also enable the steering pad 74 to move axially or circumferentially with respect to the drill bit 32. Once coupled with the steering pad 74, the outer bearing 112 blocks removal of the steering pad 74 from the directional drilling system 30 in a radial direction 156 with respect to a longitudinal axis of the directional drilling system 30.

In FIG. 4, the coupling feature 148 includes a protrusion 150 that extends from a surface 152 of the steering pad 74 and engages a recess 154 in a surface 155 of the outer bearing 112. As illustrated, the protrusion 150 defines a dovetail shape that engages a dovetail-shaped recess 154, however, the protrusion 150 and recess 154 of the coupling feature 148 may be or include any corresponding shapes or forms. In some embodiments, the steering pad 74 may define a recess that is configured to receive a protrusion on the outer bearing 112. While FIG. 4 illustrates a single protrusion 150 and a single recess 154, in some embodiments the coupling feature 148 may include multiple protrusions 150 configured to engage multiple respective recesses 154. In embodiments, there may be at least one protrusion 150 on both the steering pad 74 and on the outer bearing 112 that engage respective recesses 154 on the outer bearing 112 and on the steering pad 74.

Figure 5:
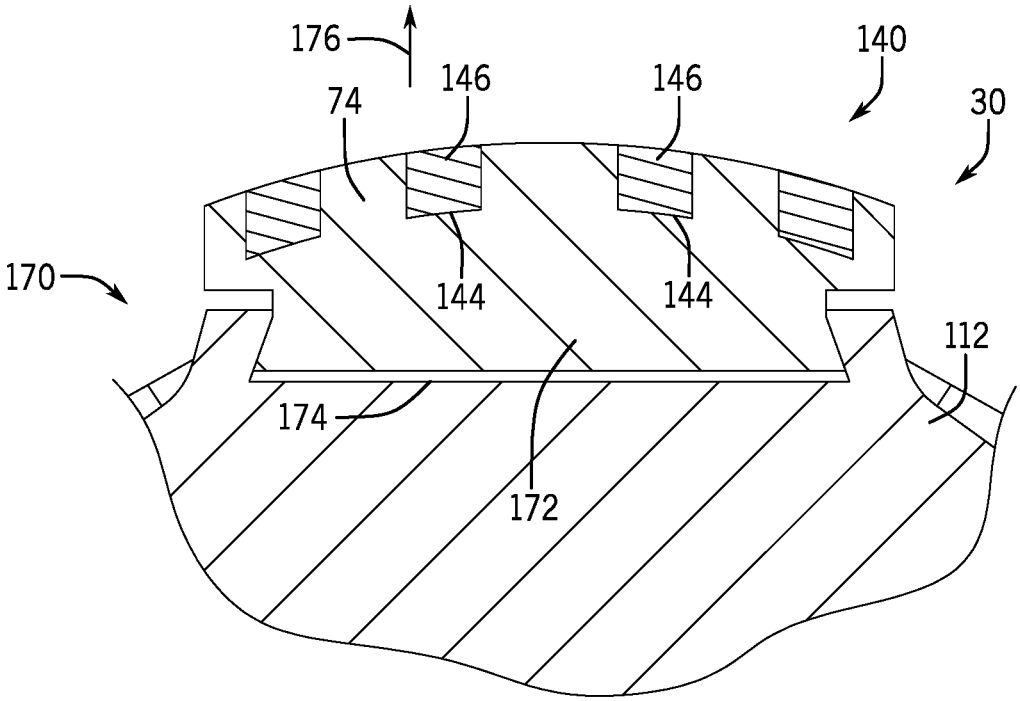
FIG. 5 is a cross-sectional view of a steering pad coupled to a directional drilling system within line 4-4 of FIG. 3 according to an embodiment of the present disclosure.
Figure 6:
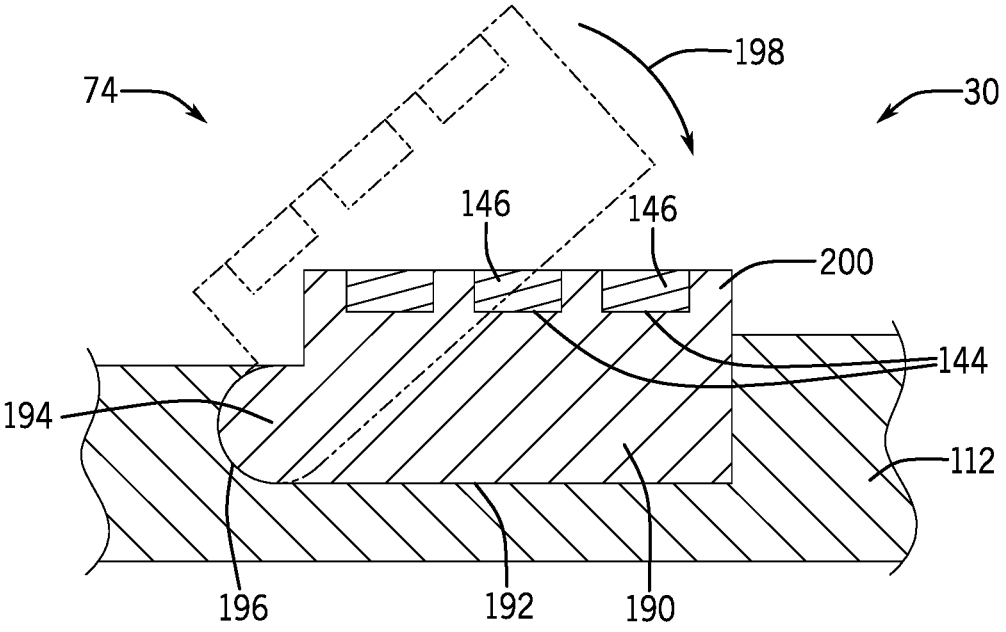
FIG. 6 is a cross-sectional view of a steering pad coupled to a directional drilling system according to an embodiment of the present disclosure.

FIG. 5 is a cross-sectional view of an embodiment of a steering pad 74 coupled to an outer bearing 112 or sleeve of a directional drilling system 30, within line 4-4' of FIG. 3. In some embodiments, the body 140 of the steering pad 74 may form a coupling feature 170. As illustrated, a section 172 of the body 140 of steering pad 74 defines a dovetail shape that engages a corresponding recess 174 on the outer bearing 112 (e.g., sleeve). Once coupled with the steering pad 74, the outer bearing 112 blocks removal of the steering pad 74 from the directional drilling system 30 in a radial direction 176 with respect to a longitudinal axis of the directional drilling system 30. In some embodiments, the steering pad 74 may define a recess (e.g., like recess 174) that receives a protrusion (e.g., like section 172) on the outer bearing 112. FIG. 6 is a cross-sectional view of an embodiment of a steering pad 74 coupled to an outer bearing 112 or sleeve of a directional drilling system 30. As illustrated, a portion 190 of the steering pad 74 sits within a cavity 192. To facilitate insertion and retention, the steering pad 74 defines a curved end portion 194 (e.g., retention feature). During installation, the curved end portion 194 is inserted into a corresponding curved section 196 of the cavity 192. The steering pad 74 may then be rotated in direction 198 until the rest of the steering pad 74 rests within the cavity 192. In order to block removal of the steering pad 74 from the cavity 192, the steering pad 74 may be welded or brazed about an exposed portion 200 of the steering pad 74. In some embodiments, one or more fasteners (e.g., threaded fasteners) may secure the steering pad 74 within the cavity 192.

Figure 7:
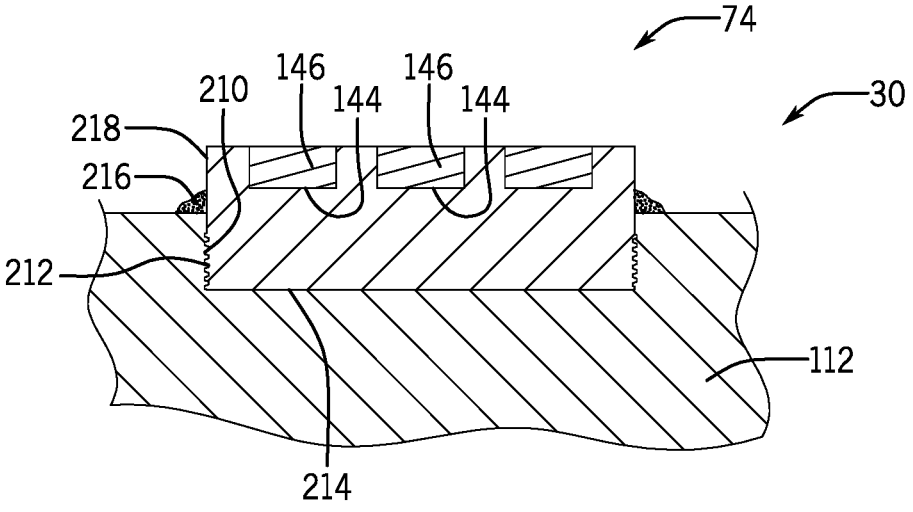
FIG. 7 is a cross-sectional view of a steering pad coupled to a directional drilling system according to an embodiment of the present disclosure.

FIG. 7 is a cross-sectional view of an embodiment of a steering pad 74 coupled to an outer bearing 112 or sleeve of a directional drilling system 30. As illustrated, the steering pad 74 (e.g., circular steering pad) may be threadingly coupled to the directional drilling system 30. For example, the steering pad 74 may include threads 210 that engage threads 212 about a cavity 214. To block removal of the steering pad 74 from the cavity 214, the steering pad 74 may be welded or brazed 216 about an exposed portion 218 of the steering pad 74. In some embodiments, one or more fasteners (e.g., threaded fasteners) may also be used to secure the steering pad 74 within the cavity 214.

Figure 8:
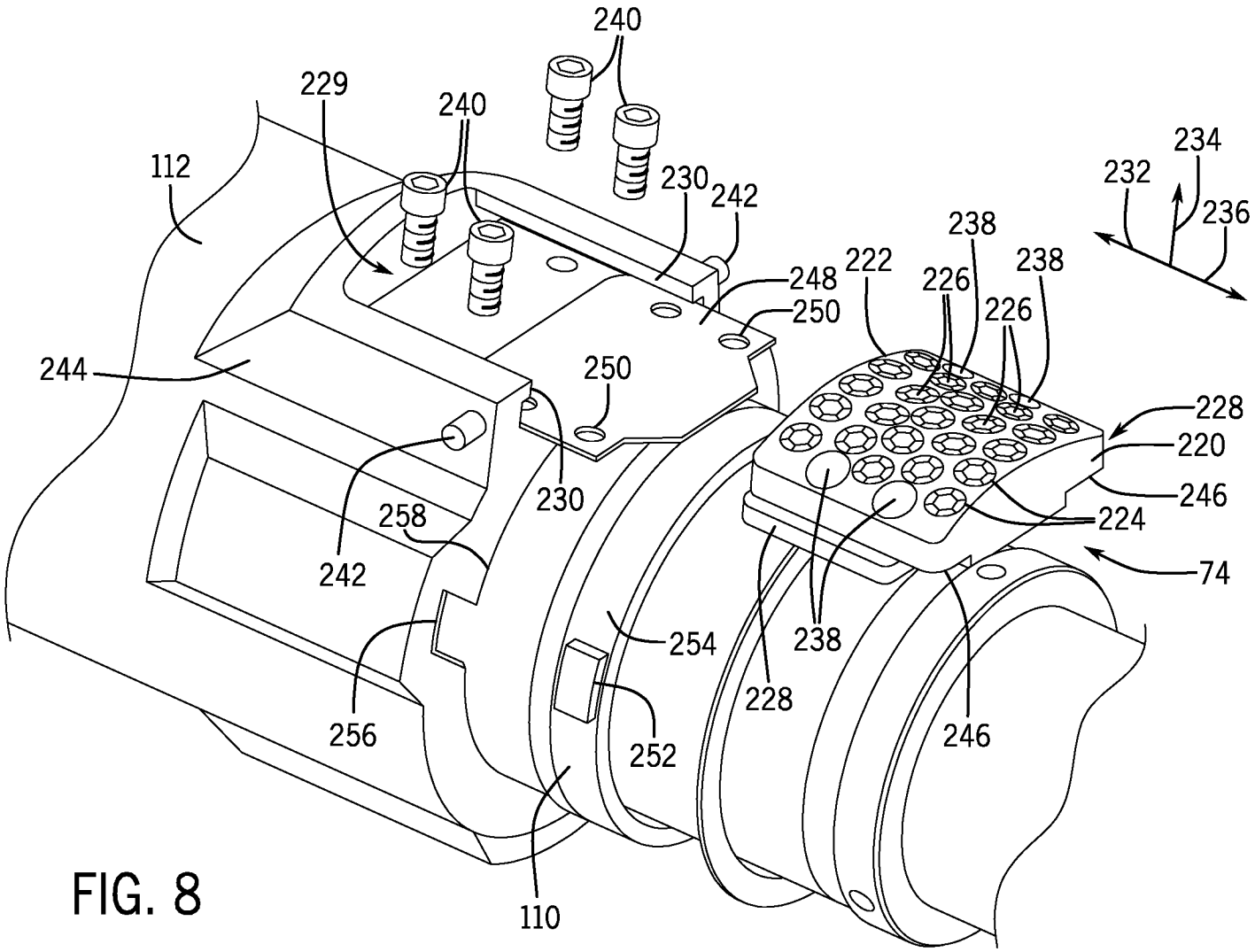
FIG. 8 is a perspective view of a steering pad coupling to a directional drilling system according to an embodiment of the present disclosure.

FIG. 8 is a perspective view of an embodiment of a steering pad 74 coupling to an outer bearing 112 or sleeve of a directional drilling system 30. The steering pad 74 includes a body 220 made out of a first material (e.g., carbides, including without limitation tungsten or other transition metal carbides). The body 220 defines a curvilinear surface 222 configured to engage the rock face 66 described above. The body 220 may also include a plurality of counterbores 224 in the curvilinear surface 222. The counterbores 224 enable the steering pad 74 to receive a plurality of inserts 226. The inserts 226 may include diamond inserts, boron nitride inserts, carbide inserts (e.g., tungsten or other transition metal carbide inserts), or a combination thereof. The inserts may be conventional polycrystalline diamond cutters (PDC or PCD cutters). These inserts 226 provide abrasion resistance as the steering pad 74 engages the rock face 66.

As illustrated, the steering pad 74 includes one or more flanges 228. The flange(s) 228 are configured to slide beneath protrusions 230 in a recess 229 on the outer bearing 112 or sleeve as the steering pad 74 slides axially in direction 232. Once coupled the protrusions 230 block removal of the steering pad 74 in a radial direction 234 with respect to a longitudinal axis of the directional drilling system 30. In some embodiments, the steering pad 74 may define recesses instead of flanges that are configured to engage the protrusions 230 to block movement of the steering pad 74 in radial direction 234. In some embodiments, the steering pad may be held geostationary (non-rotationary with respect to the borehole/earth) and/or substantially geostationary.

In order to block removal of the steering pad 74 in axial direction 236 from the cavity 229 the steering pad 74 may include one or more apertures 238. The apertures 238 may receive threaded fasteners 240 (e.g., bolts or the like) that engage the outer bearing 112 or sleeve to block axial movement of the steering pad 74 in axial direction 236. In some embodiments, additional fasteners 242 may pass through walls 244 of the outer bearing 112 or sleeve that defines the recess 229. These fasteners 242 may engage apertures and/or may rest within notches 246 on the steering pad 74 to block axial movement of the steering pad 74 in axial direction 236.

In some embodiments, one or more shims 248 may be inserted into the recess 229 to lift the steering pad 74 in radial direction 234. For example, a shim 248 may be used to ensure that the curvilinear surface 222 extends a desired distance from the exterior surface of the outer bearing 112 or sleeve. In some embodiments, the shims 248 may also include apertures 250, which may be configured to receive the threaded fasteners 240 to block axial removal or shifting of the shims 248 during drilling operations.

In some embodiments, the inner bearing 110 may include one or more (e.g., one, two, three or more) protrusions 252 that extend radially outward from an exterior surface 254. The protrusions 252 are configured to engage respective recesses or notches 256 on an interior surface 258 of the outer bearing or sleeve 112. During operation of the directional drilling system 30, the protrusions 252 are configured to block or reduce relative motion between the inner bearing 110 and the outer bearing 112.

Figure 9:
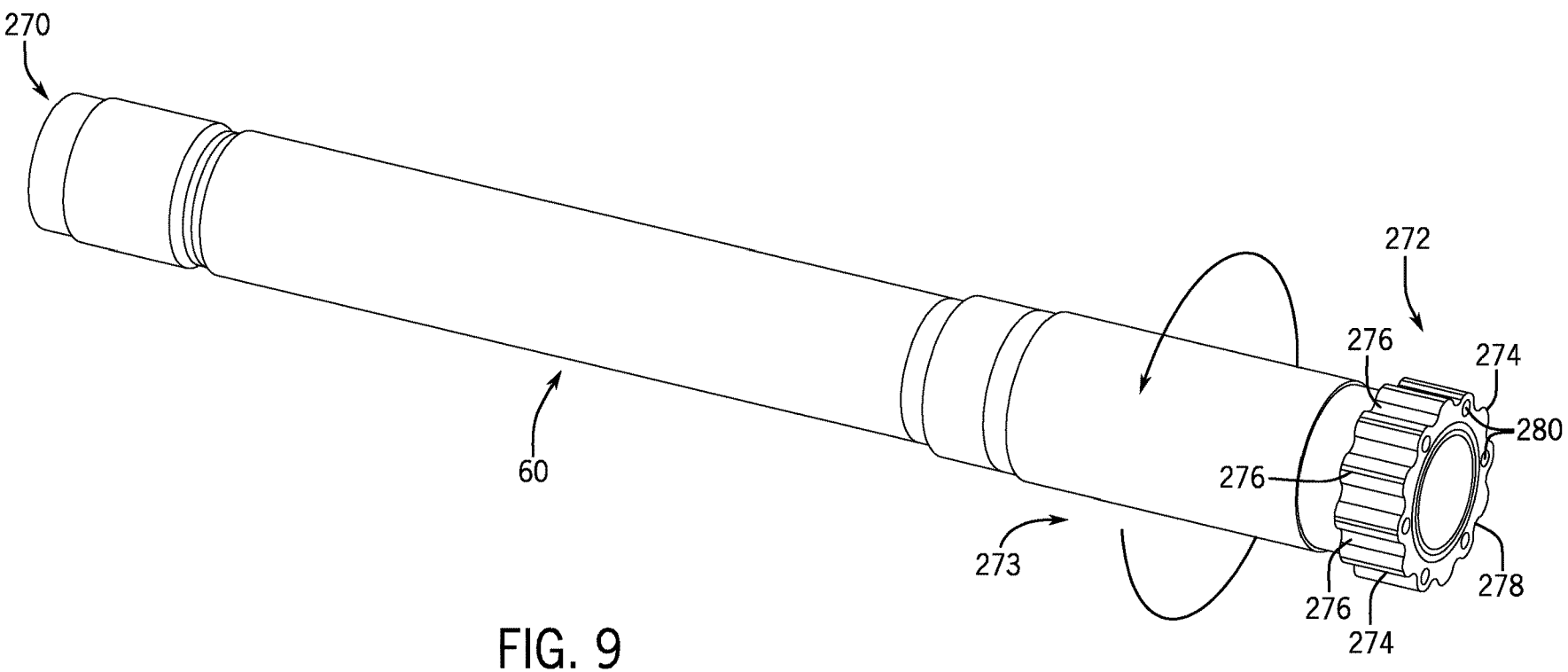
FIG. 9 is a perspective view of a drive shaft of a directional drilling system according to an embodiment of the present disclosure.

FIG. 9 is a perspective view of an embodiment of a drive shaft 60 of the directional drilling system 30. The drive shaft 60 defines a first end 270 and a second end 272 opposite the first end 270. The first end 270 is configured to couple to a drill motor (e.g., hydraulic motor or mud motor, electric motor), while the second end 272 is configured to couple to the drill bit 32. In order to couple to the drill bit 32, the second end 272 includes an exterior surface 273 that defines a plurality of protrusions 274 separated by recesses 276. In some embodiments, this pattern may be a cloverleaf pattern. Once coupled to the drill bit 32, the plurality of protrusions 274 may engage recesses in the drill bit 32, enabling torque transfer from the drive shaft 60 to the drill bit 32. In some embodiments, the end face 278 may define one or more apertures 280 that enable the drill bit 32 to be coupled to (e.g., bolted onto) the drive shaft 60. In some embodiments, there is a minimum defined radius in the surface transitions between the protrusions (e.g., 1 mm, 5 mm, 10 mm, 15 mm, or 20 mm) to minimize stress concentrations in the surface. In other embodiments, the surface may be continuously curved, minimizing any section of constant radius from the center of the shaft (e.g., to less than 30, 20, or 10 degrees).

Figure 10:
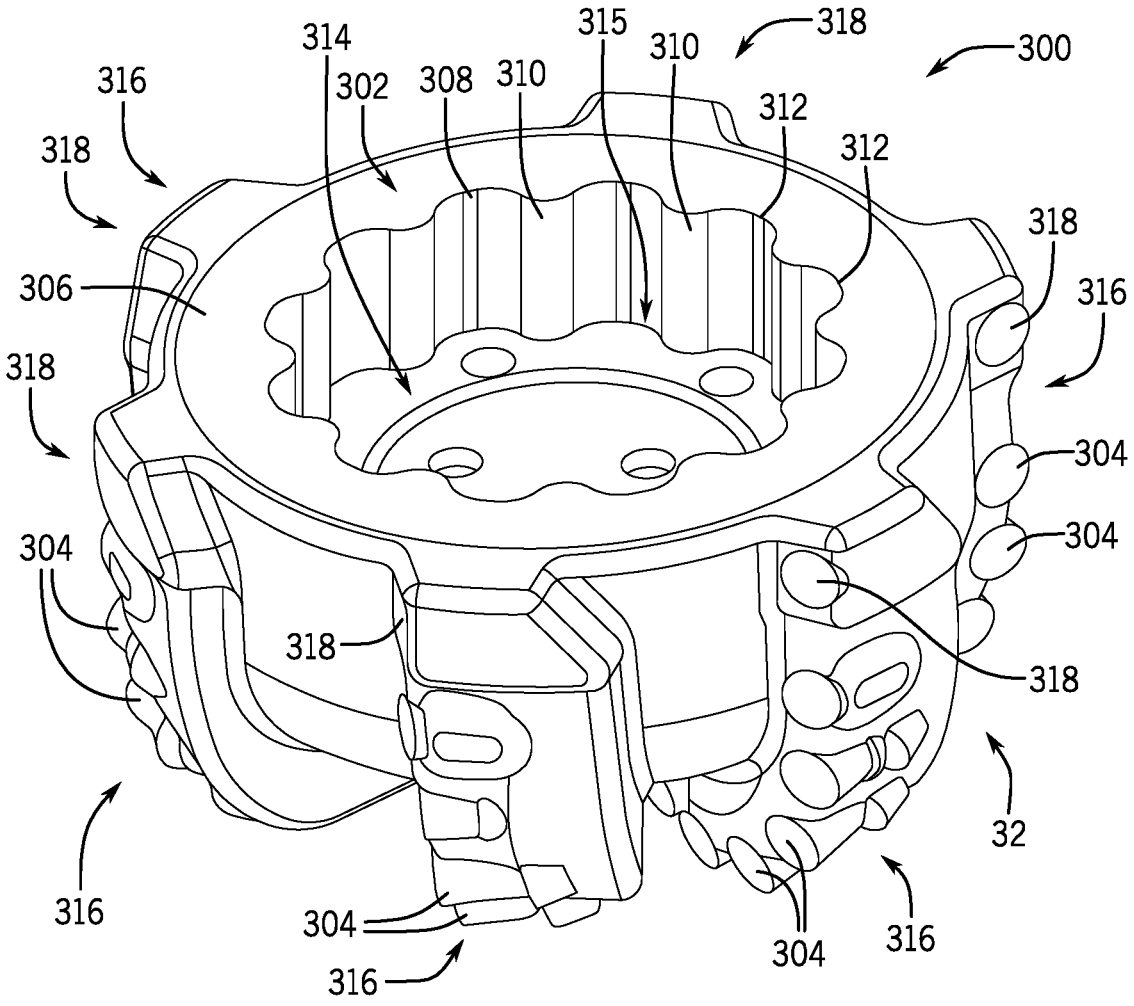
FIG. 10 is a cross-sectional view of a drill bit according to an embodiment of the present disclosure.

FIG. 10 is a perspective rear view of an embodiment of a drill bit 32. As illustrated, the drill bit 32 includes an exterior portion or body 300 and an interior portion or body 302. The exterior portion 300 and the interior portion 302 may be formed from the same or different materials. Because the interior portion 302 does not contact the rock face 66 while drilling, the interior portion 302 may be made from a different material. For example, the exterior portion 300 may be formed from carbide (e.g., tungsten or other transition metal carbide) and may include teeth or cutters 304 (e.g., diamond) embedded in the carbide, while the interior portion 302 may be formed from steel (e.g., steel alloy). Moreover, because the interior portion 302 couples the drill bit 32 to the drive shaft 60, the interior portion 302 may be made out of a material capable of manufacturing with tighter tolerances (e.g., steel, steel alloy).

As illustrated, the interior portion 302 may be a ring 306 with an interior surface 308 defining a plurality of protrusions 310 separated by recesses 312. The interior portion 302 rests within a cavity 314 of the drill bit 32 and may couple to the drill bit 32, for example, with a press fit, brazing, welding, gluing, and/or fasteners. The shape of the interior portion 302 exposes a plurality of apertures 315 in the exterior portion 300. As will be explained below, these apertures 315 enable drilling mud to flow through the drill bit 32 or to enable the drill bit 32 to couple to the drive shaft 60 with fasteners. In some embodiments, the exterior portion 300 and interior portion 302 may be formed from the same material. In some embodiments, the exterior portion 300 and interior portion 302 may be one piece and/or integrally formed.

As illustrated, the drill bit 32 includes a plurality of blades 316 with multiple teeth or cutters 304. The teeth or cutters 304 facilitate the breaking of rock and/or sediment into cuttings as the drill bit 32 rotates. In some embodiments, each blade 316 may include an end tooth or cutter 318 at the same axial position as the end tooth or cutters 318 of the other blades 316 proximate to an end of the drill bit 32. The end teeth or cutters 318 may form the angle 80 between the steering pad 74 and the drill bit 32 that enables the steering pad 74 to change the drilling direction 39, 116 to any other direction. By including an end tooth or cutter 318 for each of the blades 316, the drill bit 32 may also provide redundancy in the event that one of the other end teeth or cutters 318 separates from the drill bit 32 during operation.

Figure 11:
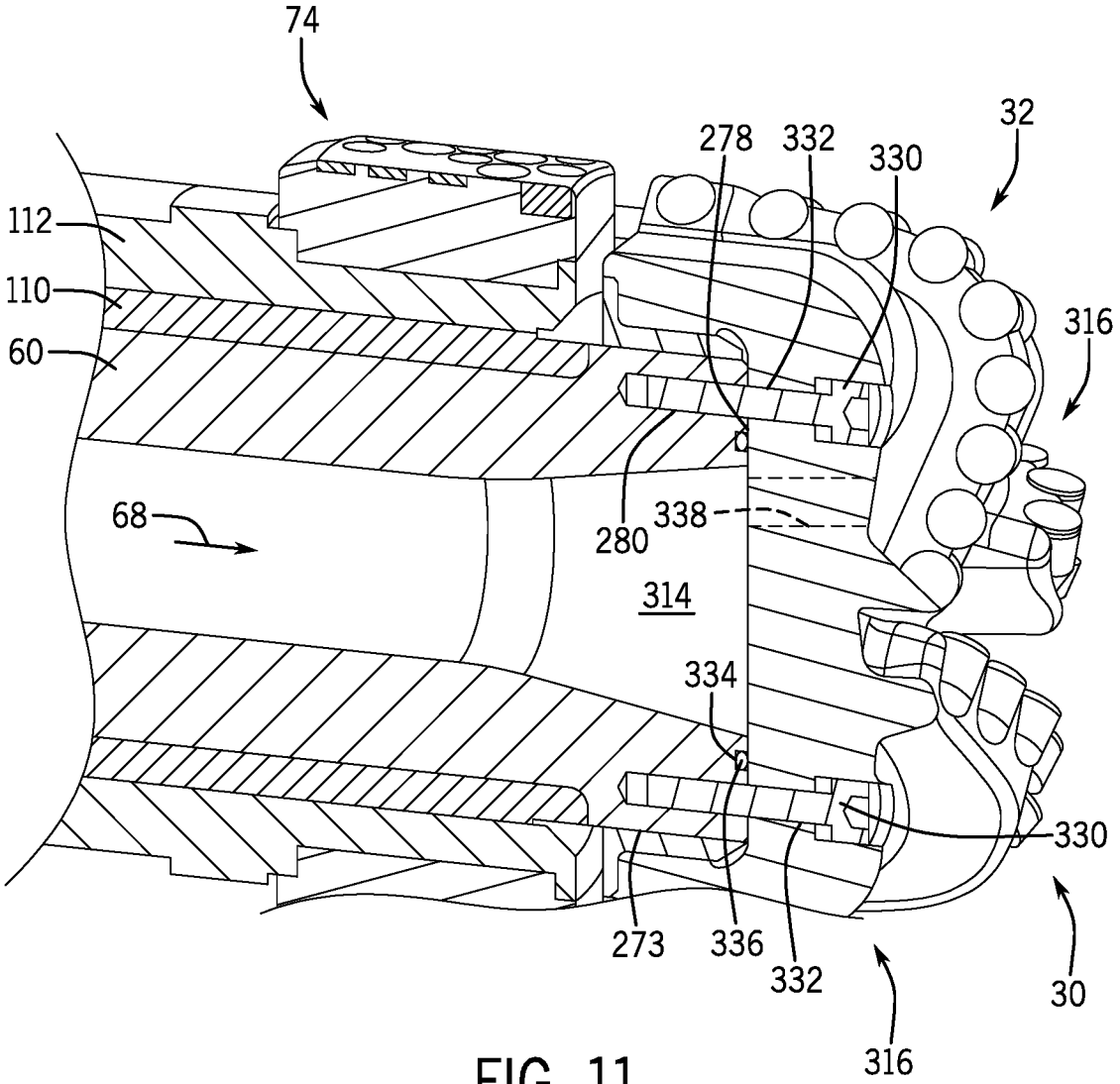
FIG. 11 is a cross-sectional view of a directional drilling system according to an embodiment of the present disclosure.

FIG. 11 is a cross-sectional side view of an embodiment of a directional drilling system 30 with the drive shaft 60 coupled to the drill bit 32. As explained above with reference to FIG. 9, the second end 272 of the drive shaft 60 includes an exterior surface 273 with a plurality of protrusions 274 separated by recesses 276. As explained above with reference to FIG. 10, this exterior surface 273 of the drive shaft 60 matches the protrusions 310 and recesses 312 on the interior surface 308 of the interior portion 302 (ring 306) of the drill bit 32. The drive shaft 60 may therefore slide into and couple to the drill bit 32 by aligning the protrusions 274 on the drive shaft 60 with the recesses 312 on the ring 306, and the protrusions 310 on the ring 306 with the recesses 276 on the drive shaft 60. Once coupled, the drive shaft 60 is configured to transfer torque from the drive shaft 60 to the drill bit 32.

Returning now to FIG. 11, to reduce or block axial movement of the drive shaft 60 with respect to the drill bit 32, one or more fasteners 330 couple the drill bit 32 to the drive shaft 60. For example, the fasteners 330 may extend through apertures 332 and into apertures 280 in the end face 278 of the drive shaft 60. In some embodiments, the drive shaft 60 may define an annular groove 334 in the end face 278 that receives an annular seal 336. In operation, the annular seal 336 forms a seal with the drill bit 32 to focus the flow of drilling mud through apertures 338.

Figure 12:
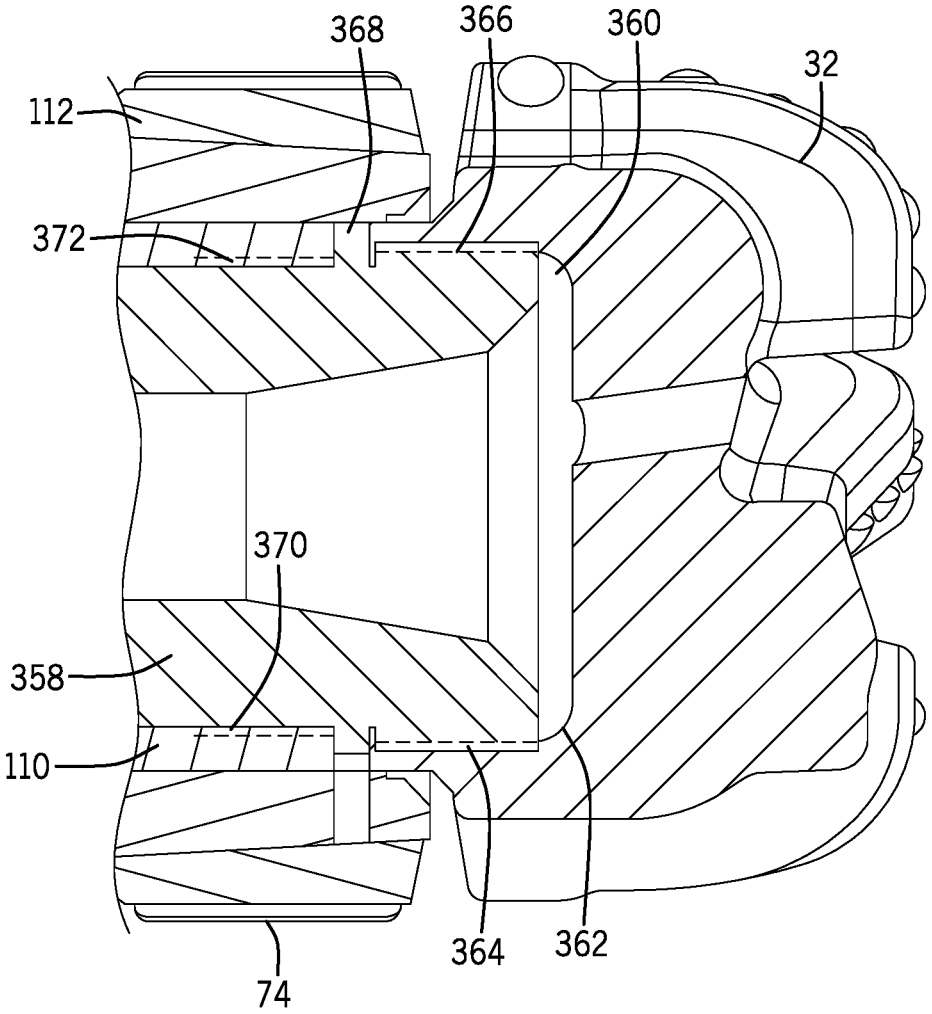
FIG. 12 is a perspective view of a drill bit threadingly coupled to a drive shaft according to an embodiment of the present disclosure.

FIG. 12 is a perspective view of an embodiment of a drill bit 32 threadingly coupled to a drive shaft 358. As illustrated, the drill bit 32 may define a counterbore 360 with a surface 362. In order to couple to the drive shaft 358, the surface 362 of the drill bit 32 may include threads 364 that engage threads 366 on the drive shaft 358. In some embodiments, the drive shaft 358 may include one or more (e.g., one, two, three, four, five, or more) protrusions 368. For example, a protrusion 368 may be an annular protrusion that extends about the circumference of the drive shaft 358. In operation, the protrusion(s) 368 enable an increase in torque when coupling the drill bit 32 to the drive shaft 358. The drive shaft 358 may also include threads 370 that enable the drive shaft 358 to threadingly couple to threads 372 on the inner bearing 110. The protrusion(s) 368 may also enable an increase in torque when coupling the inner bearing 110 to the drive shaft 358.

Figure 13:
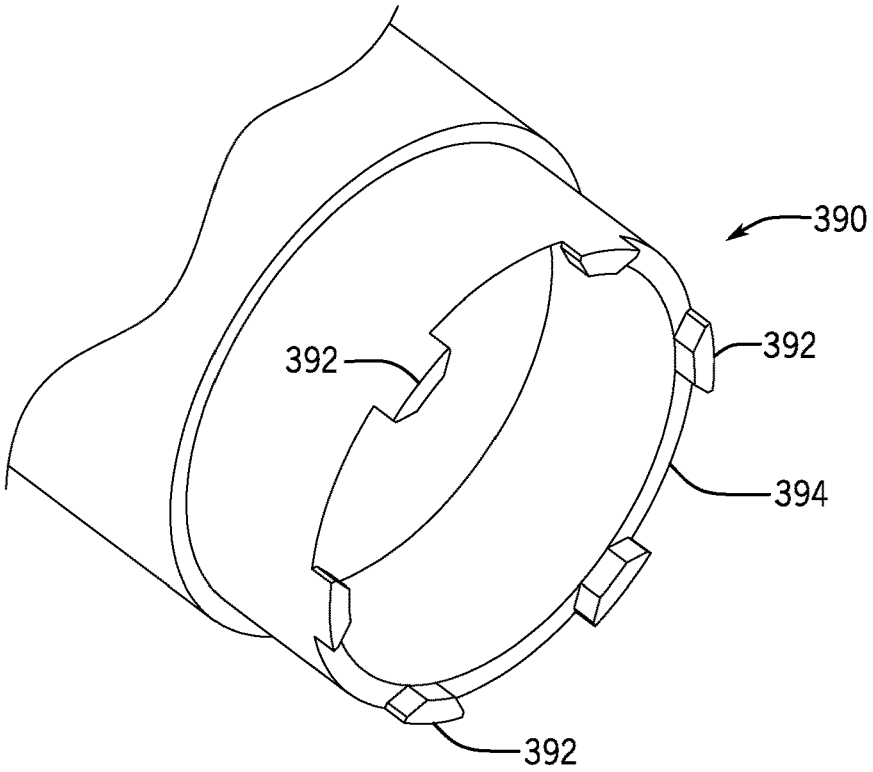
FIG. 13 is a perspective view of an inner bearing according to an embodiment of the present disclosure.

FIG. 13 is a perspective view of an embodiment of an inner bearing 390. The inner bearing 390 may or may not include threads for coupling to the drive shaft 60 described above. However, to block relative motion between the inner bearing 390 and the drive shaft 60, the inner bearing 390 may include one or more protrusions or tabs 392 spaced evenly (as shown) or unevenly about an end face 394 of the inner bearing 390. In operation, these protrusions 392 are configured to axially engage the drive shaft 60 to block rotation of the inner bearing 390 relative to the drive shaft 60.

Figure 14:
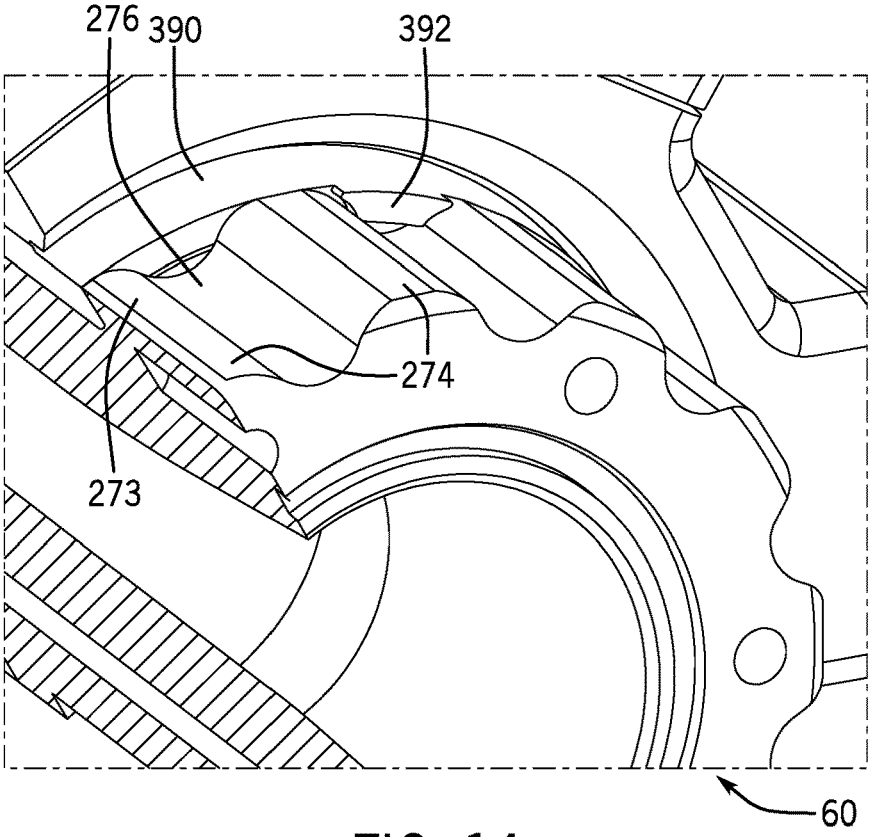
FIG. 14 is a perspective view of an inner bearing coupled to a drive shaft according to an embodiment of the present disclosure.

FIG. 14 is a perspective view of an embodiment of an inner bearing 390 coupled to the drive shaft 60 of FIG. 9. As explained above, the second end 272 of the drive shaft 60 is configured to couple to the drill bit 32. In order to couple to the drill bit 32, the second end 272 includes an exterior surface 273 that defines a plurality of protrusions 274 separated by recesses 276. These protrusions 274 and recesses 276 enable the drive shaft 60 to couple to and transfer torque to the drill bit 32. The protrusions 274 and recesses 276 may also axially receive the protrusions 392 on the inner bearing 390 to block relative motion of the inner bearing 390 with respect to the drive shaft 60.

Figure 15:
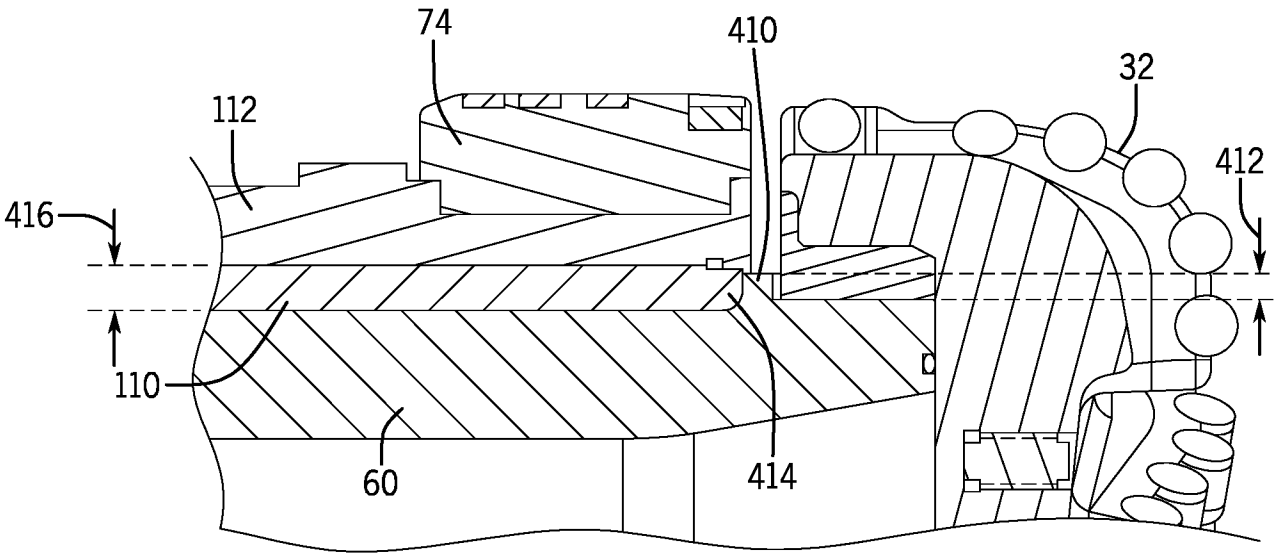
FIG. 15 is a partial cross-sectional view of a directional drilling system according to an embodiment of the present disclosure.

FIG. 15 is a partial cross-sectional view of an embodiment of the directional drilling system 30. During operation of the directional drilling system 30, an axial force is transferred through the drill string to the drill bit 32. This axial force compresses the drill bit 32 against the rock face. Accordingly, as the drill bit 32 rotates, the drill bit 32 is able to grind against and break up rock. This axial force may be transferred at least partially through the inner bearing 110 to the drive shaft 60. By including a shoulder 410 (e.g., an annular shoulder) with a width 412 that is equal to or at least 50% of the width 416 of the inner bearing 110, the contact area between the end face 414 of the inner bearing 110 and the shoulder 410 increases. An increase in the contact area enables an increase in the force applied to the drill bit 32 through the drive shaft 60.

Figure 16:
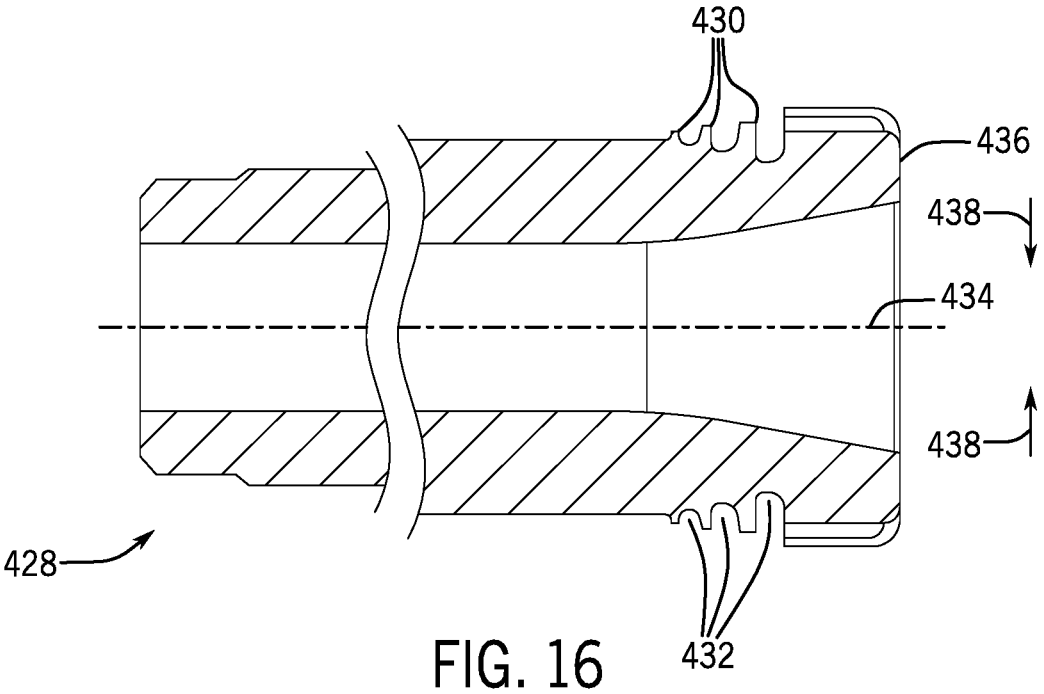
FIG. 16 is a cross-sectional view of a drive shaft according to an embodiment of the present disclosure.

FIG. 16 is a cross-sectional view of an embodiment of a drive shaft 428. In FIG. 16 the drive shaft 428 includes a plurality of shoulders 430 (e.g., annular shoulders) and a plurality of recesses 432 (e.g., annular recesses). The shoulders 430 provide a plurality of loading points for coupling to and absorbing axial force transmitted through an inner bearing (e.g., inner bearing 110). More specifically, the plurality of shoulders 430 and plurality of recesses 432 increase the available contact area between an inner bearing and the drive shaft 428, enabling the drive shaft 428 to absorb more axial force. In some embodiments, the shoulders 430 may progressively increase in thickness and height along the axis 434 toward an end 436 of the drive shaft 428. The recesses 432 between the shoulders 430 may also increase in both width along the axis 434 towards the end 436 as well as increase in depth in radial direction 438.

Figure 17:
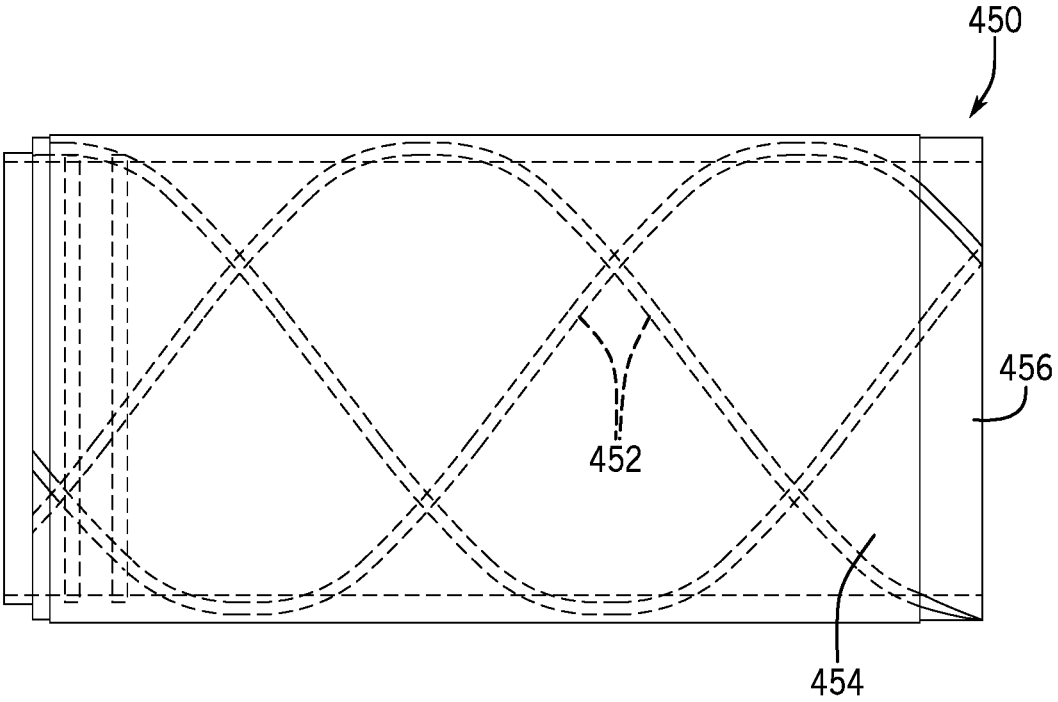
FIG. 17 is a side view of a bearing with lubrication grooves according to an embodiment of the present disclosure.

FIG. 17 is a side view of an embodiment of a bearing system 450 for use in the directional drilling system 30. As illustrated, the bearing system 450 includes lubrication grooves or channels 452 in an outer bearing 454 and in an inner bearing 456. During operation, the bearing system 450 may be lubricated with drilling fluid (e.g., drilling mud 68) that is pumped through a drill string. To facilitate lubrication, the inner bearing 456 and/or outer bearing 454 of the bearing system 450 may include lubricating grooves 452 that increase flow and/or distribution of the drilling fluid between them. The lubricating grooves 452 may wrap around the inner and outer bearings 456, 454 in a spiral pattern. For example, if the lubricating grooves 452 are on the inner bearing 456, the lubricating grooves 452 may wrap around an exterior surface of the inner bearing 456. Likewise, if the lubricating grooves 452 are on an outer bearing 454, the lubricating grooves 452 may extend along an interior surface of the outer bearing 454. In some embodiments, both the outer and inner bearings 454, 456 may include one or more lubricating grooves 452 (e.g., spiral grooves) that facilitate the flow and distribution of the drilling fluid in the bearing system 450. In addition, the lubricating grooves 452 may be sized to enable any solid particles carried in the drilling fluid (e.g., drilling mud 68) to pass through the bearing system 450. Considering the particles must pass through other flow restrictions in the drilling motor to get to this point, the minimum dimension of a lubricating groove 452 should be larger (e.g., 1.2, 1.5, 2, 3 or more times larger) than the minimum flow restriction further up the motor, e.g. an upper radial bearing in the motor.

The embodiments discussed above are susceptible to various modifications and alternative forms, specific embodiments have been shown by way of example in the drawings and have been described in detail herein. However, it should be understood that the disclosure is not intended to be limited to the particular forms disclosed.

The invention claimed is:

1. A directional drilling system, comprising:

a drill bit configured to drill a bore through rock, wherein the drill bit comprises:

an outer portion comprising a first material; and an inner portion coupled to the outer portion, wherein the inner portion comprises a second material, and wherein the first material and the second material are different; wherein the inner portion is a ring, and wherein an inner surface of the ring comprises a first plurality of protrusions that extend circumferentially about the inner surface;

a drive shaft configured to transfer torque from a motor to the drill bit, wherein the drive shaft comprises a second plurality of protrusions that extend circumferentially about the drive shaft, and wherein the first plurality of protrusions are configured to interlock with the second plurality of protrusions, wherein the drive shaft includes a drive shaft aperture in an end face of the drive shaft, wherein the outer portion of the drill bit couples to the drive shaft with at least one fastener inserted through the drive shaft aperture in the end face of the drive shaft, wherein the at least one fastener is inserted into a respective drill bit aperture in the body of the drill bit and the drive shaft aperture in the end face of the drive shaft; and a steering system configured to control a drilling direction of the drill bit, wherein the steering system comprises:

a sleeve coupled to the drive shaft; and a steering pad coupled to the sleeve, wherein the steering pad is configured to form a steering angle with the drill bit.

2. The directional drilling system of claim 1, wherein the first material comprises carbide.

3. The directional drilling system of claim 1, wherein the second material comprises steel.

4. The directional drilling system of claim 1, wherein the first plurality of protrusions define a cloverleaf pattern.

5. The directional drilling system of claim 1, comprising:

an annular seal configured to rest within an annular groove in an end face of the drive shaft, wherein the annular seal is configured to seal against the outer portion of the drill bit.

6. The directional drilling system of claim 1, wherein the outer portion comprises a plurality of teeth.

7. The directional drilling system of claim 1, wherein the first plurality of protrusions and the second plurality of protrusions have a minimum defined radius in surface transitions between protrusions of 20 mm.

8. The directional drilling system of claim 1, wherein a surface of the first plurality of protrusions and the second plurality of protrusions is continuously curved, minimizing any section of constant radius from to center of the shaft to less than 30 degrees.

9. The directional drilling system of claim 1, wherein the inner portion does not contact a rock face while drilling.

10. A directional drilling system, comprising:

a drill bit configured to drill a bore through rock;

a drive shaft coupled to the drill bit, wherein the drive shaft is configured to transfer rotational power from a motor to the drill bit using a first plurality of protrusions that extend radially from and circumferentially about the drive shaft;

a bearing system coupled to the drive shaft, wherein the bearing system comprises:

an inner bearing configured to surround and axially couple to the drive shaft wherein the inner bearing comprises a second plurality of protrusions that extend from an end face of the inner bearing, and wherein the second plurality of protrusions are configured to interlock with the first plurality of protrusions to axially couple the inner bearing to the drive shaft; and an outer bearing surrounding the inner bearing; and a steering system configured to control a drilling direction of the drill bit, wherein the steering system comprises a steering pad coupled to the outer bearing, wherein the steering pad is configured to form a steering angle with the drill bit.

11. The directional drilling system of claim 10, wherein the inner bearing comprises a lubrication groove on an exterior surface of the inner bearing, and wherein the lubrication groove is configured to carry a drilling fluid between the inner bearing and the outer bearing.

12. The directional drilling system of claim 11, wherein the lubrication groove spirals around the inner bearing from a first end of the inner bearing to a second end of the inner bearing.

13. The directional drilling system of claim 10, wherein the outer bearing comprises a lubrication groove on an interior surface of the outer bearing, and wherein the lubrication groove is configured to carry a drilling fluid between the inner bearing and the outer bearing.

14. The directional drilling system of claim 13, wherein the lubrication groove spirals from a first end of the outer bearing to a second end of the outer bearing.

15. The directional drilling system of claim 10, wherein the drill bit is configured to connect to the drive shaft with the first plurality of protrusions.

16. The directional drilling system of claim 15, wherein the drive shaft includes an aperture in an end face of the drive shaft and the drill bit is coupled to the drive shaft with a fastener inserted into the aperture.

17. A directional drilling system, comprising:

a steering system configured to control a drilling direction of a drill bit, wherein the steering system comprises:

a sleeve comprising a recess;

a steering pad coupled to the recess of the sleeve, wherein rotation of the steering pad with respect to the drill bit is configured to change the drilling direction, and wherein the steering pad is configured to couple to the sleeve with a coupling feature configured to allow axial movement of the steering pad relative to the drill bit and the sleeve during installation to change a steering angle of the drill bit, and wherein the steering pad comprises one or more apertures through an outer radial surface; and one or more fasteners coupled to the steering pad and the sleeve, wherein the one or more fasteners is configured to extend through the one or more apertures to block removal of the steering pad in an axial direction.

18. The directional drilling system of claim 17, wherein the coupling feature comprises a dovetail protrusion configured to engage the recess of the sleeve.

* * * * *